US011371257B1

(12) United States Patent
Jones

(10) Patent No.: US 11,371,257 B1
(45) Date of Patent: Jun. 28, 2022

(54) FENCE LIFT SYSTEM AND METHOD OF USE

(71) Applicant: Jeffrey S. Jones, Wilmington, NC (US)

(72) Inventor: Jeffrey S. Jones, Wilmington, NC (US)

( * ) Notice: Subject to any disclaimer, the term of this patent is extended or adjusted under 35 U.S.C. 154(b) by 274 days.

(21) Appl. No.: 16/659,647

(22) Filed: Oct. 22, 2019

(51) Int. Cl.
*E04H 17/16* (2006.01)
*E04H 17/14* (2006.01)

(52) U.S. Cl.
CPC ..... *E04H 17/16* (2013.01); *E04H 17/1448* (2021.01)

(58) Field of Classification Search
CPC ... E04H 17/1448; E04H 17/16; E06B 11/025; E01F 13/048; E01F 13/046; E05F 15/665; E05Y 2900/40
See application file for complete search history.

(56) References Cited

U.S. PATENT DOCUMENTS 1,543,199 A * 6/1925 Winebrake ..... E06B 11/023 160/37
5,118,056 A * 6/1992 Jeanise ..... E01F 13/048 246/111
5,271,183 A * 12/1993 Hahn ..... E01F 13/048 49/103
5,630,572 A * 5/1997 Guay ..... E04H 4/06 256/1
6,227,523 B1 * 5/2001 Haberlen ..... E01F 13/048 246/127
6,485,225 B1 * 11/2002 Baker ..... E01F 13/028 160/331
7,017,643 B2 * 3/2006 Leum ..... E06B 11/00 160/113
7,114,753 B2 * 10/2006 Nodorft ..... E05B 47/0002 292/137
7,563,051 B2 * 7/2009 Buckley ..... E01F 13/048 256/13.1
9,410,298 B2 * 8/2016 Kemper ..... E01F 13/048
2010/0308294 A1 * 12/2010 Watkins ..... E06B 11/025 256/73
2016/0237746 A1 * 8/2016 Schirado ..... E06B 11/021
2018/0016809 A1 * 1/2018 Hyland ..... E04H 17/14
2020/0165787 A1 * 5/2020 Dickinson ..... E05F 15/57

* cited by examiner

*Primary Examiner* — Matthew R McMahon
(74) *Attorney, Agent, or Firm* — Dogwood Patent and Trademark Law; Ashley D. Johnson

(57) ABSTRACT

A fence lift system and method of use comprises a plurality of post members; a plurality of panel members and a plurality of lift members. The post members are laterally spaced, and the panel members are secured between the post members. Each lift member is secured to a post member and attached to a panel member and configured to raise and lower the panel member.

10 Claims, 5 Drawing Sheets

FENCE LIFT SYSTEM AND METHOD OF USE

BACKGROUND

1. Field of the Invention

The present invention relates generally to fence systems, and more specifically, to a fence lift system for lifting each individual section of a fence.

2. Description of Related Art

Fence systems are well known in the art and are effective means to provide an enclose for privacy for a property owner. For example, FIG. 1 depicts an individual section of a conventional fence system 101 having two posts 103 on either side of a panel 105. During use, a plurality of posts 103 and panels 105 would connect to form a fence system.

One of the problems commonly associated with system 101 is once erected the individual fence sections remain in place permanently. This can be a problem during situations when it may be necessary to move an individual fence section. For example, when cutting grass that grows around the fence, it may be difficult or impossible to cut grass that grows around and under the base of each individual fence section. In addition, severe weather may damage or destroy individual fence sections.

Accordingly, although great strides have been made in the area of fence systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
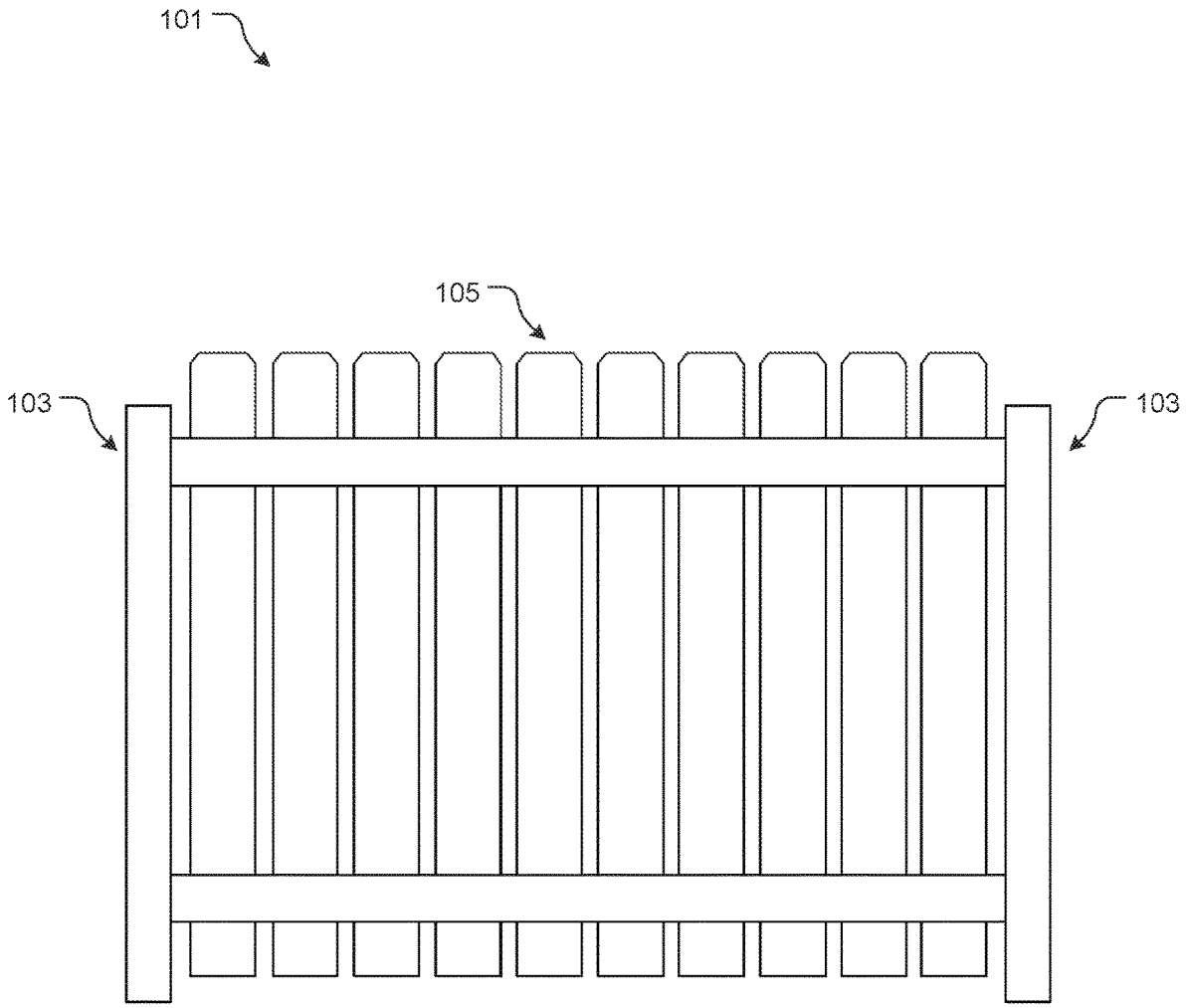
FIG. 1 (Prior Art)
FIG. 1 is a front view of a common individual section of a fence system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals; such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional fence systems. Specifically, each individual fence section may be raised, lowered or removed according to a user's preferred situation. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
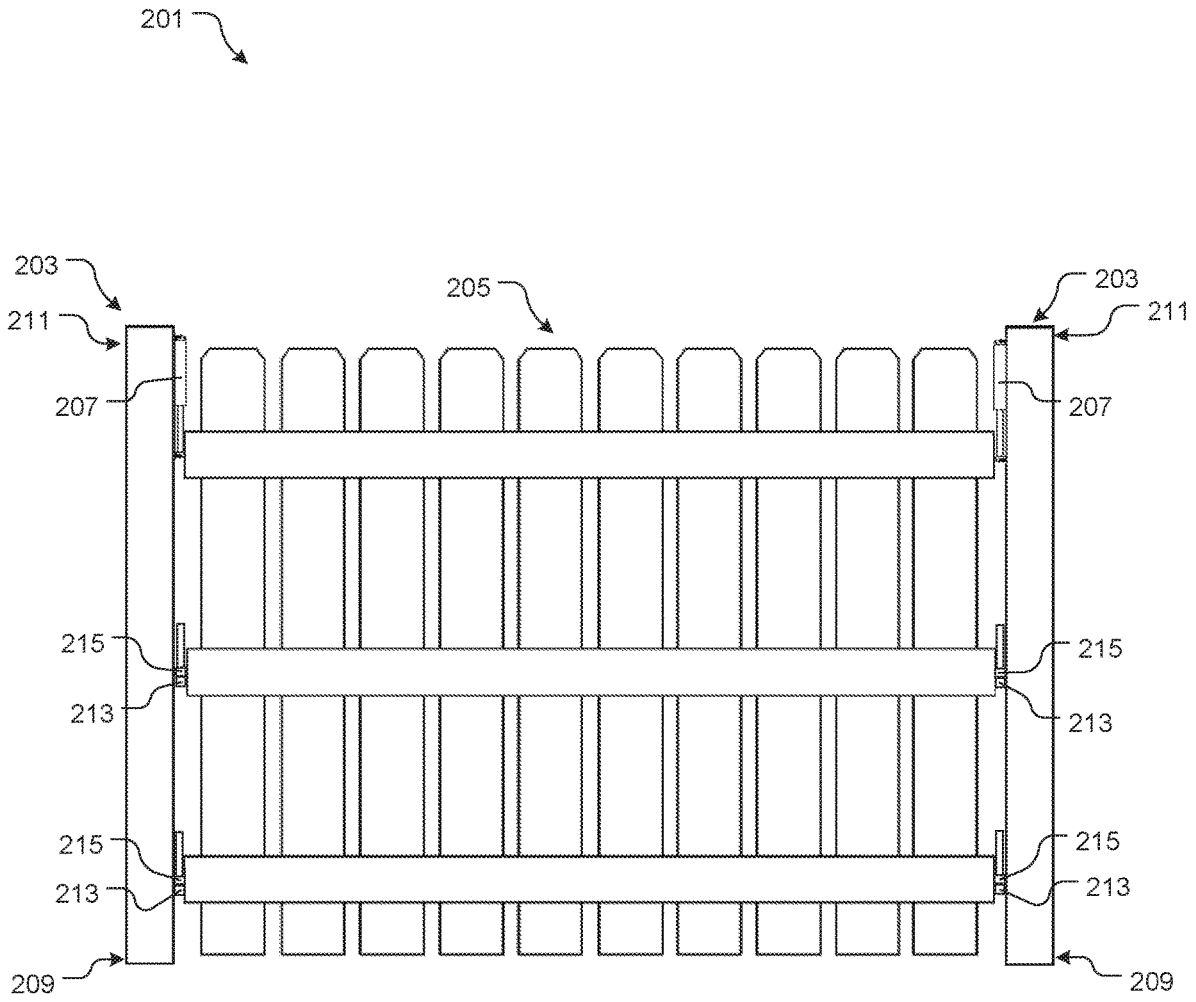
FIG. 2 is a front view of a fence lift system in a lowered configuration in accordance with a preferred embodiment of the present application.

Referring now to the drawings wherein like reference characters identify corresponding or similar elements throughout the several views, FIG. 2 depicts a front view of a fence lift system in accordance with a preferred embodiment of the present application. It will be appreciated that system 201 overcomes one or more of the above-listed problems commonly associated with conventional fence systems.

Figure 3:
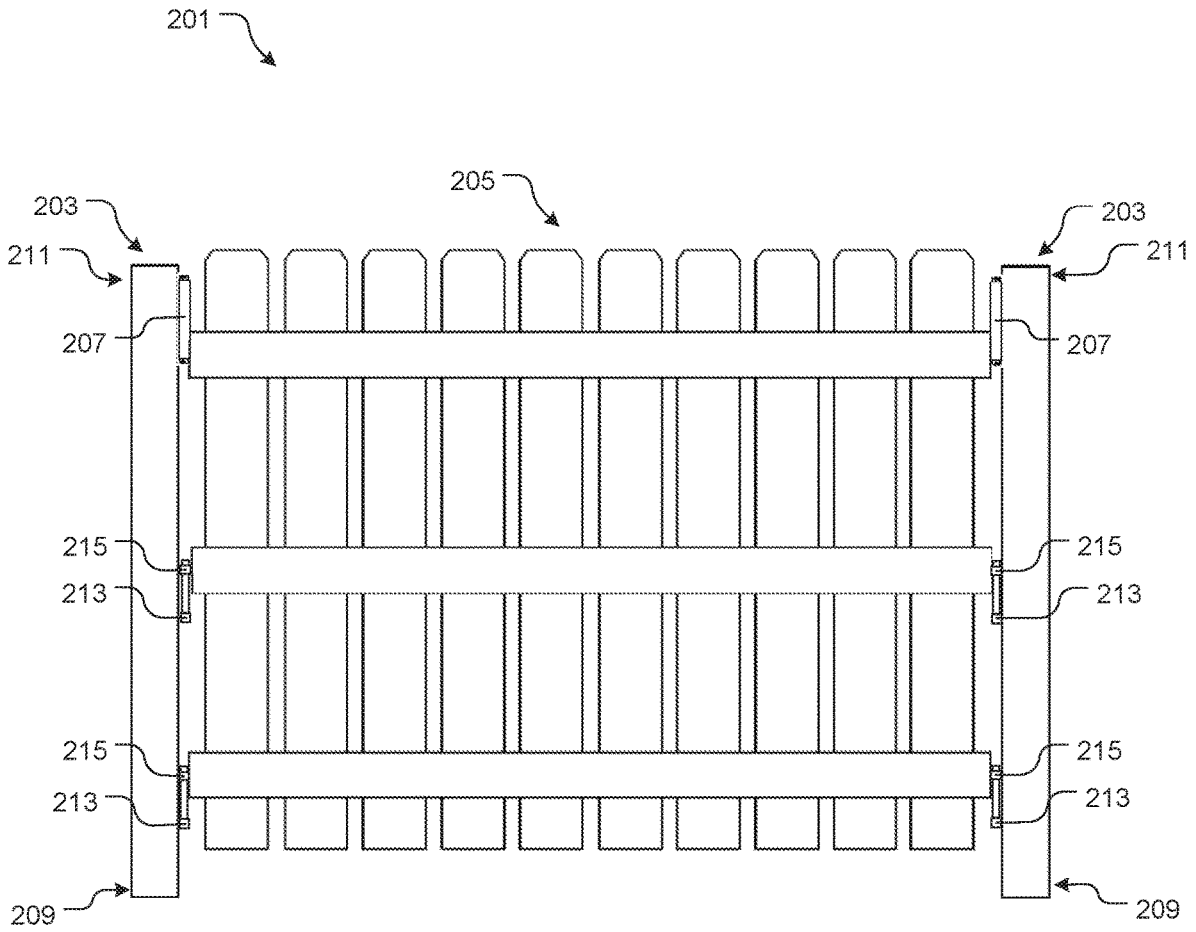
FIG. 3 is a front view of the fence lift system in a raised configuration.
Figure 4:
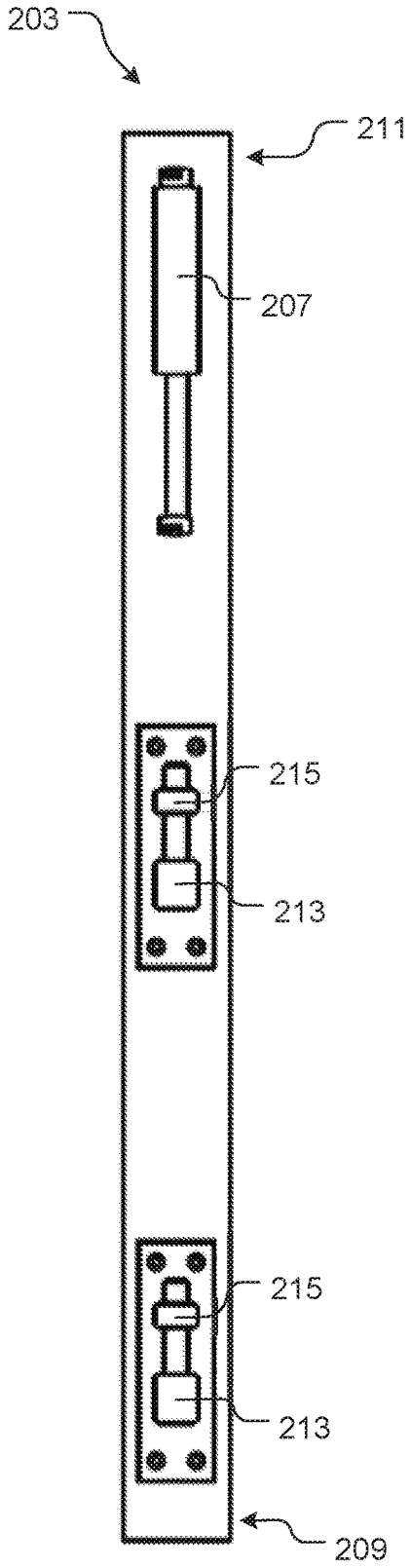
FIG. 4 is a side view of the fence lift system.
Figure 5:
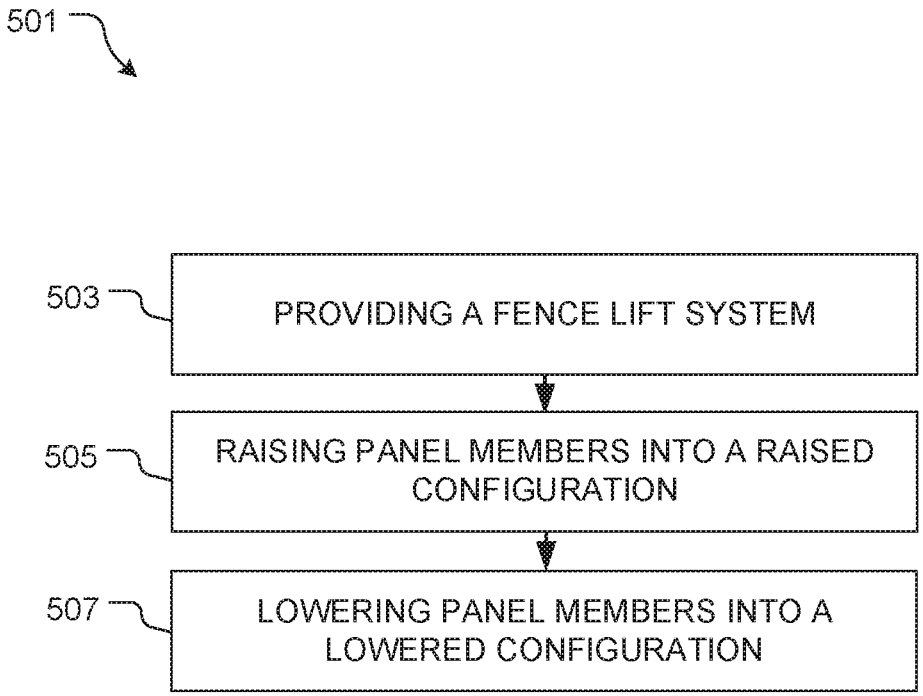
FIG. 5 is a flowchart of a method of lifting a fence.

In the contemplated embodiment, system 201 includes a plurality of post members 203, a plurality of panel members 205 and a plurality of lift members 207. The plurality of post members 203 are laterally spaced with a base end 209 affixed to a surface such as the ground and a top end 211 that extends vertically from the base end 209. Each panel member 205 is secured between two post members 203 as depicted in FIGS. 2 and 3. One side of the panel member 205 is attached to one post member 203 and another side of the panel member 205 is attached to another post member 203 forming an individual fence section. A complete privacy or other type of fence may be formed by combining a plurality of individual fence sections.

Each lift member 207 is attached to a post member 203 and connected to a panel member 205. The lift member 207 enables a raised configuration and lowered configuration for each individual fence section. System 201 may also include a locking mechanism configured to lock the individual fence section in the lowered configuration.

System 201 may further include a plurality of guide brackets 213 and a plurality of guide attachments 215, each guide attachment 215 configured to engage with a guide bracket 213. Each guide bracket 213 may include a locking nut configured to prevent the guide attachment 215 from disengaging from the guide bracket 213. One or more guide brackets 213 are attached to a post member 203 and one or more guide attachments 215 are attached to a panel member 205.

The plurality of lift members 207 may be gas struts or another device of similar function. It is anticipated that the guide brackets 213 and the guide attachments 215 are complementary pieces that are shaped to fit together. However, it should be appreciated that other such pieces and shape may be used.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A fence lift system, comprising:

a plurality of laterally spaced post members, each post member having:

a base end;

a top end; and wherein each post member extends vertically from the base end to the top end;

a plurality of panel members, each panel member secured between two post members wherein a first side of the panel member is connected to a first post member and a second side of the panel member is connected to a second post member;

wherein each post member comprises an exterior surface defined by an interior edge that faces the plurality of panel members; and a lift member secured to the interior edge of each of the plurality of laterally spaced post members and attached to the plurality of panel members enabling a raised configuration and a lowered configuration of the plurality of panel members relative to the plurality of laterally spaced post members; and a plurality of guide brackets positioned on the interior edge of each of the plurality of laterally spaced post members, wherein the plurality of guide brackets engage with a plurality of guide attachments positioned on the plurality of panel members, wherein the plurality of guide attachments slide relative to the plurality of laterally spaced post members and fixedly engage with the plurality of panel members;

wherein each lift member lifts the plurality of panel members during transition between the lowered configuration and the raised configuration; and wherein each lift member is a gas strut.

2. The fence lift system of claim 1, further comprising a plurality of locking mechanisms configured to lock each lift member in the lowered configuration.

3. The fence lift system of claim 1, further comprising a plurality of locking nuts disposed on the plurality of guide brackets and configured to prevent the plurality of guide attachments from disengaging from the plurality of guide brackets.

4. The fence lift system of claim 1, wherein each interior edge of each laterally spaced post member comprises two guide brackets.

5. The fence lift system of claim 4, wherein a first guide bracket is positioned in an approximate center of the interior edge of each laterally spaced post member.

6. The fence lift system of claim 4, wherein a second guide bracket is positioned adjacent to the base end of the interior edge of each laterally spaced post member.

7. The fence lift system of claim 1, wherein each panel member comprises two guide attachments.

8. The fence lift system of claim 1, wherein the lift member is positioned adjacent to the top edge of the interior edge of each laterally spaced post member.

9. A method of lifting a fence, the method comprising:

providing the system of claim 1;

raising the plurality of panel members into the raised configuration; and lowering the plurality of panel members into the lowered configuration.

10. The method of lifting of fence of claim 9, further comprising locking the plurality of panels members in the lowered configuration.

* * * * *